United States Patent [19]

Riedl et al.

[11] 3,966,197

[45] June 29, 1976

[54] METHOD AND APPARATUS FOR CONTROLLED FEEDING OF SHEETS TO PRINTING MACHINES OR THE LIKE

[75] Inventors: Rudi Riedl; Regina Jungnickel; Rainer Nitsch, all of Leipzig; Werner Lein, Radebeul; Lothar Vetter, Radebeul; Helmut Schone, Radebeul; Günter Weisbach, Radebeul; Hans Johne, Radebeul; Alfred Schott, Radebuel; Karl-Heinz Forster; Albrecht Johne, both of Dresden, all of Germany

[73] Assignee: VEB Polygraph Leipzig Kombinat fur Polygraphische Maschinen und Ausrustungen, Leipzig, Germany

[22] Filed: Mar. 13, 1975

[21] Appl. No.: 558,117

Related U.S. Application Data

[62] Division of Ser. No. 357,790, Nov. 19, 1973.

[52] U.S. Cl. ..... 271/260; 271/103

[51] Int. Cl.[2] ..... B65H 7/14

[58] Field of Search ..... 271/90, 93, 103, 104, 271/108, 259, 260; 270/56

[56] References Cited

UNITED STATES PATENTS 1,715,360 6/1929 Harrold ..... 271/103

2,837,333 6/1958 Sindzinski et al. ..... 271/90

*Primary Examiner*—Evon C. Blunk
*Assistant Examiner*—Robert Saifer
*Attorney, Agent, or Firm*—Michael J. Striker

[57] ABSTRACT

A printing machine receives single sheets which are removed from a stack by the suction cups of a feeding mechanism which is combined with a monitoring unit serving to detect the absence of sheets at the undersides of suction cups or the lifting of two or more sheets. The monitoring unit employs a transducer having two feelers which determine the thickness of lifted sheet material and an indicating device which is actuated by the feelers and produces signals serving to indicate the absence of sheets, the lifting of two or more sheets and/or to control the operation of the printing machine. The suction cups can form part of the transducer when the latter is designed to detect only the absence of sheets or they form part of a second transducer which is provided in addition to the first mentioned transducer.

1 Claim, 20 Drawing Figures

FIG. 2
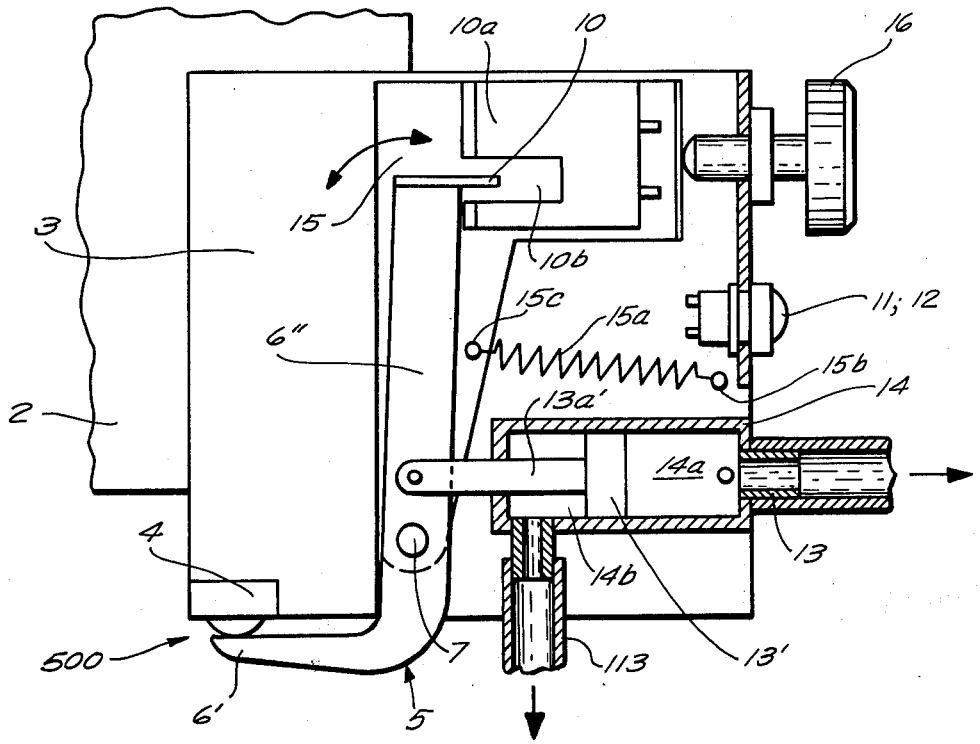
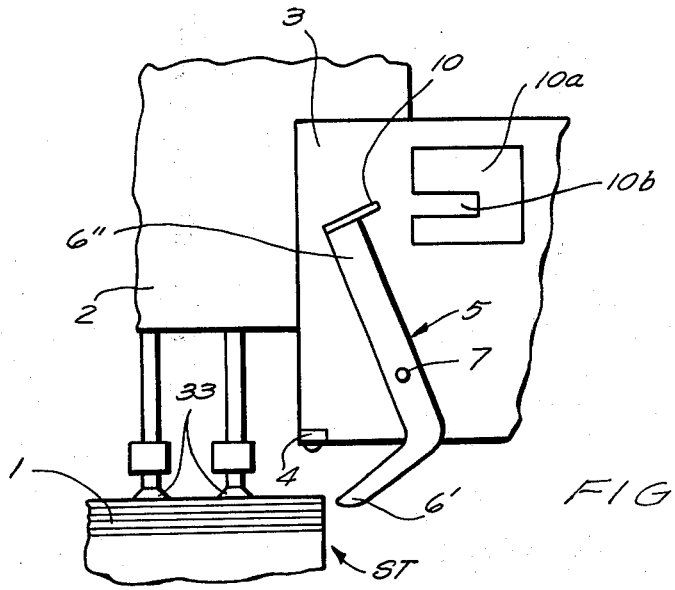
FIG. 2a

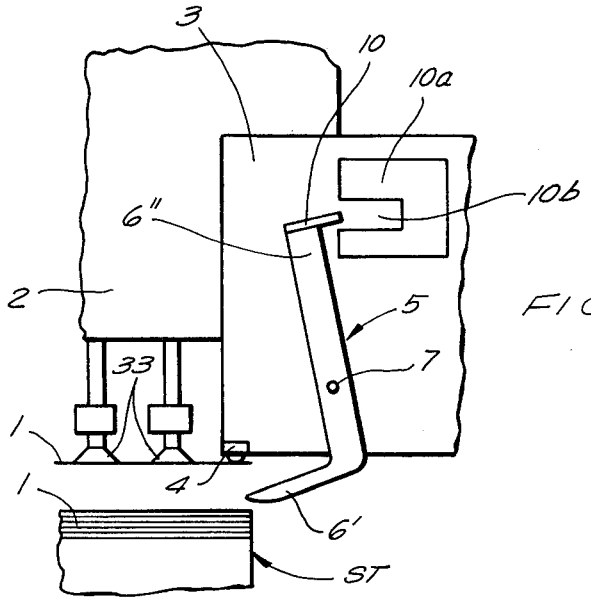
FIG. 2b
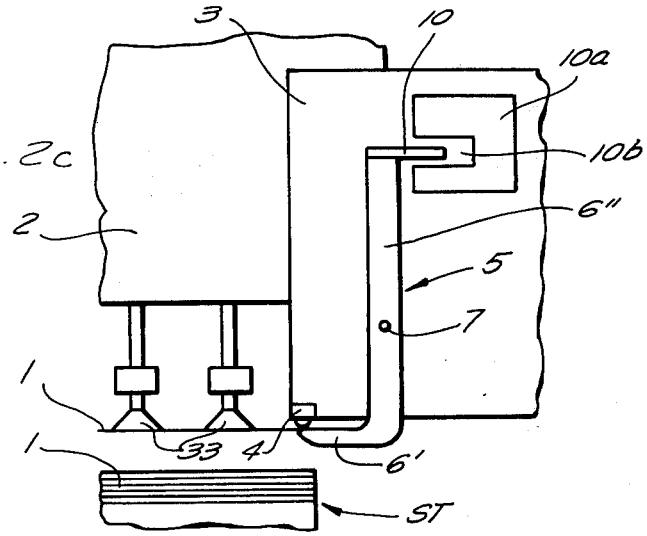
FIG. 2c
FIG. 2d
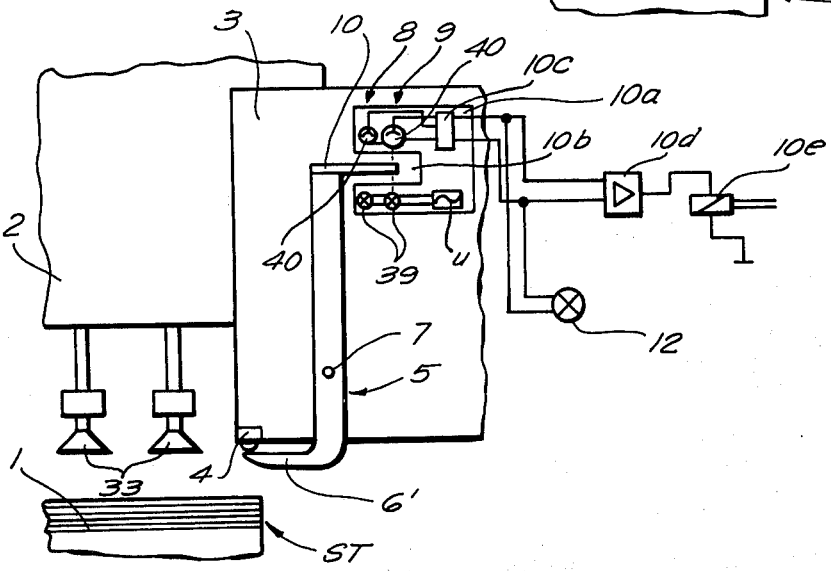

FIG. 5a
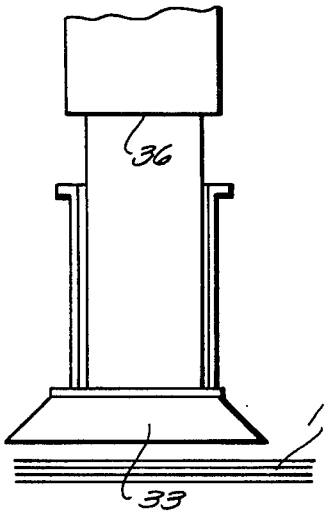
FIG. 5b
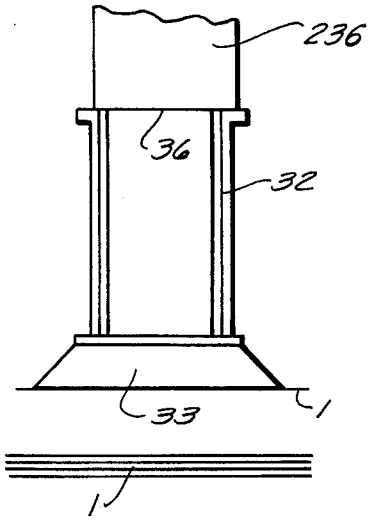
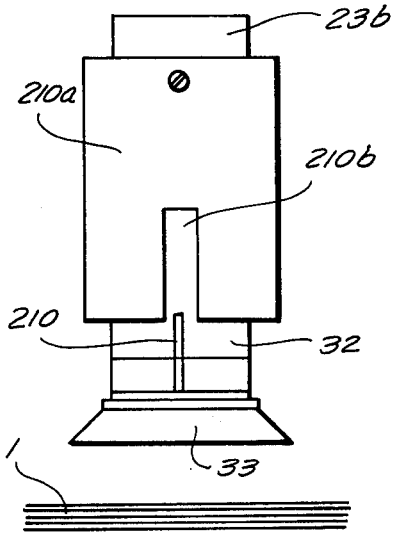
FIG. 6
FIG. 7
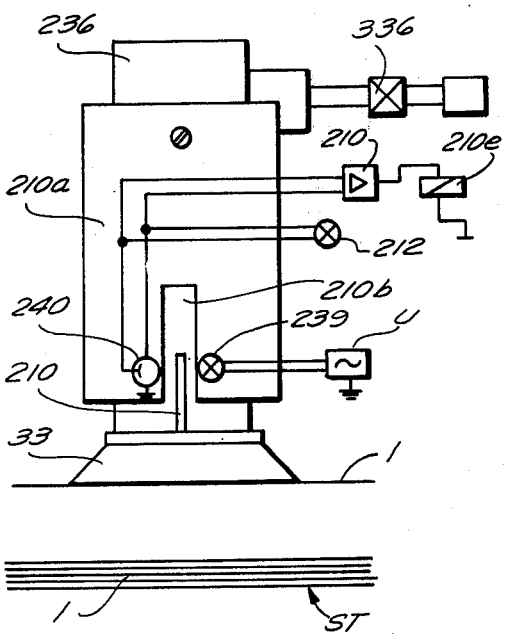

METHOD AND APPARATUS FOR CONTROLLED FEEDING OF SHEETS TO PRINTING MACHINES OR THE LIKE

This is a division of application Ser. No. 357,790, filed Nov. 19, 1973.

BACKGROUND OF THE INVENTION

The present invention relates to a method and apparatus for controlled feeding of sheets from a stack of sheets into a printing or another sheet processing or consuming machine. More particularly, the invention relates to a method and apparatus for feeding sheets of paper or the like in such a way that each and every failure of the sheet feeding mechanism to remove from the stack a predetermined number of sheets (normally a single sheet) at a time results in the generation of signals which can be used to eliminate the cause of malfunctioning and/or for other purposes.

Unsatisfactory feeding of sheets is attributable to malfunctioning of the sheet feeding mechanism, to exhaustion of the supply of sheets which form a stack, to improper stacking of sheets, and/or to a tendency of sheets in the stack to adhere to each other with a force that cannot be overcome by the suction cups or analogous sheet lifting or removing members of the feeding mechanism.

It is well known that faulty operation of the sheet feeding mechanism in or for a printing or like machine can cause serious problems. Such problems arise when the feeding mechanism fails to deliver a sheet as well as when the feeding mechanism delivers more than a desired number of sheets. For example, the printing machine is likely to dispense ink into or onto its parts when no sheet is held in proper position for reception of ink, and the surplus sheets are likely to clog the printing machine and or cause damage to or even a breakage of its parts. Therefore, the surplus sheets should be intercepted prior to their entry into the processing machine.

It is already known to combine a sheet feeding mechanism with various control devices which monitor the operation of the sheet feeding mechanism and produce signals in response to detected absence of sheets and/or in response to detected presence of more than a desired number of sheets. In accordance with a presently known proposal, the sheet material which is removed by the feeding mechanism is scanned by a monitoring device which is capable of detecting the presence of two or more sheets and unlocks a rotary segment which closes a switch to thereby generate a signal for transmission to the processing machine. A drawback of this monitoring device is that it is reliable only while the sheets are being fed at a relatively low rate; when such rate is exceeded, the parts of the monitoring device begin to vibrate and are likely to indicate the presence of two or more sheets even if the feed of sheets is entirely satisfactory. Another drawback of this monitoring device is that its operation is too slow because its parts must scan each removed sheet individually. Moreover, the just described mode of monitoring is likely to compound the errors in scanning of individual sheets, and the generation of a signal in response to detection of more than a desired number of sheets is delayed to such an extent that one or more additional sheets are likely to enter the processing machine before the latter is arrested or otherwise influenced in response to the generation of a signal.

It was further proposed to combine a sheet feeding mechanism with a system of suction cups serving to separate from each other those sheets which are removed by the feeding mechanism whenever the mechanism removes more than a single sheet. Such system failed to gain widespread acceptance in the industry because the separation of sheets which adhere to each consumes much time and also because the separating action of suction cups is not sufficiently reliable, especially if the feeding mechanism has removed three or more sheets.

SUMMARY OF THE INVENTION

An object of the invention is to provide a novel and improved method of feeding sheets which consist of paper or the like to a printing or another sheet processing machine in such a way that improper operation of the sheet feeding mechanism results in immediate generation of one or more signals whenever the feeding mechanism removes more or less than a desired number of sheets at a time.

Another object of the invention is to provide a method according to which the generation of signals in response to detected absence of sheets is just as rapid as the generation of signals in response to detected presence of surplus sheets.

A further object of the invention is to provide in or in combination with a printing or another sheet consuming machine a novel and improved monitoring device which can influence the operation of the processing machine whenever the sheet feeding mechanism fails to deliver a desired or optimum number of sheets.

An additional object of the invention is to provide a monitoring device which can be combined with or which can form an integral part of presently known sheet feeding mechanisms for delivery of sheets into a printing or another sheet processing machine.

Still another object of the invention is to provide a sheet feeding mechanism which embodies a novel and improved monitoring device capable of interrupting or otherwise influencing the operation of a printing or another sheet processing machine whenever the feeding mechanism delivers more or less than a desired number of sheets.

A further object of the invention is to provide a monitoring device whose sensitivity can be adjusted with little loss in time, with a high degree of accuracy, and in such a way that it takes into consideration eventual fluctuations in the thickness of sheets.

One feature of the invention resides in the provision of a method of feeding sheets from a stack of sheets into a printing or other processing machine, e.g., into a composite printing machine wherein the sheets are transported through two or more successive printing units. The method comprises the steps of subjecting successive topmost sheets of the stack to a pneumatic lifting action (preferably to the action of suction) which normally results in the lifting of a single sheet to a scanning station, monitoring the scanning station for the number of sheets therein subsequent to each lifting action, transferring successively lifted single sheets from the scanning station into a predetermined path for transport into the processing machine, and interrupting the operation of the processing machine whenever the monitoring of the scanning station results in the detected absence of a sheet at the scanning station.

The method preferably further comprises the step of interrupting the operation of the processing machine whenever the monitoring of the scanning station results in the detected presence of plural (two or more) sheets at the scanning station, and the interrupting step (in response to detected absence of sheets and or in response to detected presence of plural sheets at the scanning station) preferably comprises interrupting the operation of the processing machine with a predetermined delay such as is normally necessary for the transport of a single sheet from the scanning station into the processing machine.

The sheets at the top of the stack may but need not be loosened (e.g., by one or more mechanical and/or pneumatic loosening devices) in the course of and/or prior to each pneumatic lifting action. The monitoring of the scanning station preferably includes measuring the thickness of sheet material at the scanning station (if the thickness is zero, this indicates the absence of a sheet: on the other hand, if the thickness is more than the maximum anticipated thickness of a sheet, this indicates that the lifting action resulted in delivery of two or more sheets to the scanning station).

The method preferably further comprises the steps of redepositing the plural sheets at least once back on top of the stack and again subjecting the topmost sheet of the stack to a stack and pneumatic lifting action for the purpose of lifting a single sheet to the scanning station.

The method may further include the steps of transferring the plural sheets from the scanning station into the predetermined path and intercepting the plural sheets in the predetermined path prior to actual entry of plural sheets into the processing machine. The thus intercepted plural sheets may be removed from the predetermined path (e.g., by hand) or are automatically transferred into a second path for transport to a collecting station or elsewhere.

The novel features which are considered as characteristic of the invention are set forth in particular in the appended claims. The improved sheet feeding and monitoring apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged fragmentary partly side elevational and partly sectional view of the sheet feeding apparatus of FIG. 1;

FIG. 2*a* is a side elevational view similar to that of FIG. 2 but showing a movable feeler of the monitoring device in a first position;

FIG. 2*b* is a view similar to that of FIG. 2*a* but showing the movable feeler in an intermediate position;

FIG. 2*c* is a view similar to that of FIG. 2*a* but showing the movable feeler in a second position;

FIG. 2*d* illustrates the parts of the sheet feeding apparatus of FIG. 2 in positions they assume when the lifting members fail to remove a sheet from the stack;

FIG. 5*a* illustrates the lifting member of FIG. 5 in a first position;

FIG. 5*b* illustrates the lifting member of FIG. 5 in a second position.

FIG. 6 is a view as seen from the left-hand side of FIG. 5; and

FIG. 7 is a view similar to that of FIG. 6 but further showing the details of the indicating device.

DESCRIPTION OF THE PREFERRED EMBODIMENTS

Figure 1:
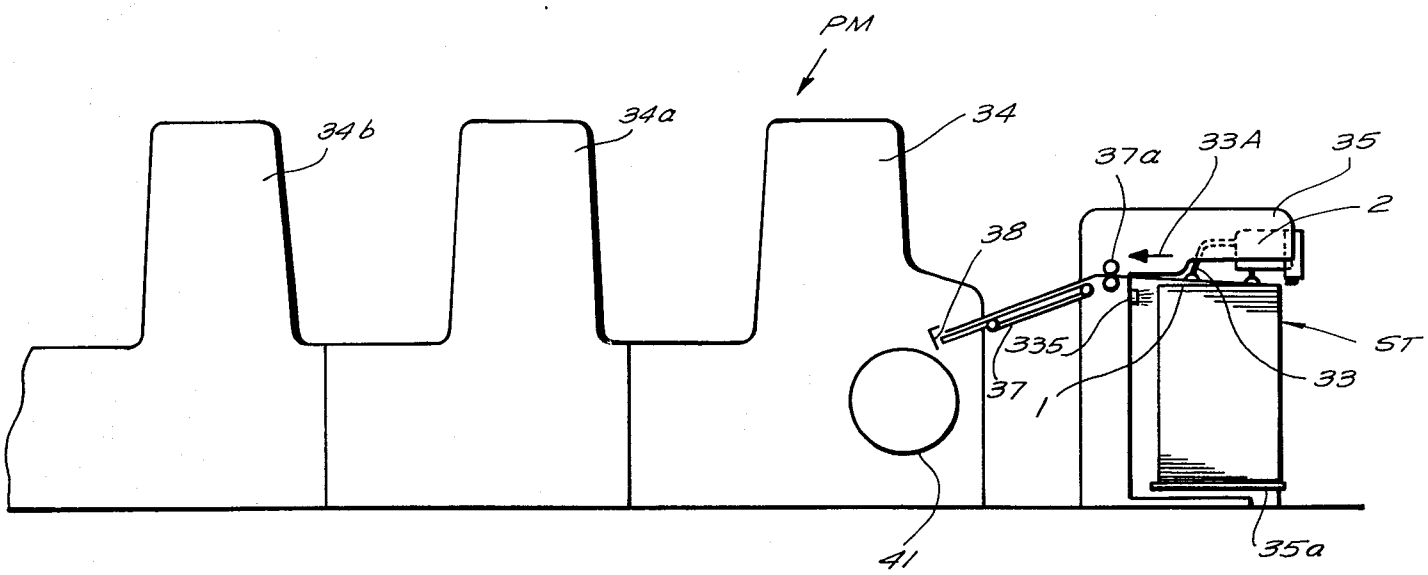
FIG. 1 is a schematic side elevational view of a printing machine and of a sheet feeding apparatus which embodies one form of the invention.

Referring first to FIG. 1, there is shown a printing machine PM having a battery of printing units 34, 34*a*, 34*b* wherein successive paper sheets 1 are imprinted in a manner not forming part of the present invention. FIG. 1 merely shows that the first printing unit 34 comprises a rotary drum 41 located behind retractable intercepting members or stops 38 which cause successive sheets 1 to assume predetermined positions prior to permitting them to advance into the range of the drum 41. A conveyor 37 is provided upstream of the stops 38 to feed successive sheets 1 lengthwise or sideways and receives such sheets from advancing rolls 37*a* mounted in a frame 35 supporting the improved sheet feeding apparatus. The frame 35 contains a vertically movable platform or table 35*a* which constitutes a mobile support for a stack ST of sheets 1. The platform 35*a* is movable upwardly, as viewed in FIG. 1, by a mechanism of known design (not shown) so that the topmost sheet 1 of the stack ST is located at a predetermined level prior to being raised by a lifting mechanism including one or more lifting members in the form of suction cups 33 which are movable up and down as well as toward and away from the advancing rolls 37*a*. When the lifting members or cups 33 lift a paper sheet 1 above and away from the next-following sheet of the stack ST on the table 35*a*, they are caused to move in the direction indicated by arrow 33A so as to advance the leading edge of the lifted sheet into the nip of the advancing rolls 37*a*. From there on, the sheet is transported by the conveyor 37 and is properly oriented by the stops 38 which are thereupon retracted so that the sheet can enter the first printing unit 34.

FIG. 2 illustrates certain parts of a first monitoring device which serves to determine whether or not the lifting members or suction cups 33 have failed to lift a sheet 1 off the stack ST, whether or not the suction cups 33 have lifted a single sheet 1 (proper operation of the sheet feeding apparatus) or whether or not the suction cups have lifted two or more sheets. The operation of this monitoring device is based on the principle of determining the thickness of the sheet material which has been lifted by the suction cups 33 whereby the zero thickness represents or indicates the absence of sheets, a first range of thicknesses indicates the presence of a single lifted sheet, and a second range of thickness indicates the presence of several sheets. The arrangement is preferably such that, when the suction cups 33 lift several sheets 1 at a time, the sheets are redeposited on the stack ST at least once (but preferably twice or even more frequently) whereupon the lifting operation begins anew for the purpose of lifting a single sheet. When they lift two or more sheets at a time, the suction cups 33 are prevented from moving the leading edges of such sheets into the nip of the advancing rolls 37*a;* this results in the generation of a signal which is delayed by a suitable relay or other time-delay means so as to cause an interruption of printing operation in the printing units 34, 34*a* and 34*b*. If repeated lifting of the topmost sheet 1 invariably results in the lifting of two or more sheets, the thus lifted multiple sheets are moved by suction cups 33 into the nip of the advancing rolls 37*a* and are taken over by the conveyor 37 for transport against the stops 38. However, the monitoring device then produces a signal which is used to prevent a retraction of the stops 38 so that the sheets which adhere to each other cannot enter the printing unit 34 proper and remain in abutment with the stops 38 to be removed by hand or to be automatically rerouted into a different second path for transport into a collecting receptacle or the like, not shown.

The operation of the monitoring device is analogous when the suction cups 33 fail to lift a sheet 1 off the stack ST on the table or support 35*a*. The monitoring device then produces a signal which is used to interrupt with a predetermined delay the operation of printing units 34, 34*a*, 34*b*. The suction cups 33 will fail to lift a sheet 1 when the table 35*a* is empty or when a large number of sheets at the top of the stack ST tend to adhere to each other and the combined weight of coherent sheets is sufficient to prevent their lifting by the suction cups 33.

The frame 35 may support suitable means for loosening the sheets at the top of the stack St on the table 35*a*, for example, one or more nozzles 335 which discharge one or more jets of air to facilitate the lifting of discrete sheets by the suction cups 33. The determination of thickness of sheet material which has been lifted by the suction cups 33 off the stack ST takes place at a scanning station 500 located at a level above the stack (see FIG. 2).

The upper part of the frame 35 carries a supporting box 2 for the suction cups 33 as well as for a plate-like carrier 3 which supports several parts of a transducer of the monitoring device. These parts include a movable scanning lever or feeler 5 (FIG. 2) which is pivotal mounted on a horizontal shaft 7 and has a lower arm 6' adapted to cooperate with a fixed scanning member or feeler 4 here shown in the form of a semispherical or semicylindrical protuberance located at the scanning station 500 at a level above the lower arm 6' of the movable feeler 5. The feeler 5 is pivotable in synchronism with operation of the printing units 34, 34*a*, 34*b* by a motor or drive in the form of a fluid-operated (e.g., pneumatic) cylinder and piston unit having a double-acting cylinder 14 for a piston 13' whose piston rod 13*a'* is articulately connected with the upper arm 6'' of the movable feeler 5. When the right-hand cylinder chamber 14*a* receives pressurized fluid by way of a conduit 13, the feeler 5 pivots counterclockwise and the tip of its lower arm 6' moves away from the fixed feeler 4. The admission of pressurized fluid into the cylinder chamber 14*b* by way of a conduit 113 results in a clockwise pivotal movement of the feeler 5 so that its lower arm 6' moves toward the feeler 4 whereby the trailing edge(s) of one or more sheets 1 which have been lifted off the stack ST by the suction cups 33 are scanned between the feeler 4 and arm 6' to determine their thickness and to thus detect whether or not the suction cups 33 support a single sheet, two or more sheets or no sheets at all.

The upper arm 6'' of the movable feeler 5 carries a plate-like element 10 which forms part of an indicating device serving to furnish electric signals which are indicative of the number of sheets between the arm 6' and the fixed feeler 4. Such signals are used to maintain the printing units 34, 34*a*, 34*b* in operation (when the suction cups 33 lift a single sheet 1 at a time), to interrupt the operation of the printing units in response to detected absence of a sheet or in response to detection of two or more lifted sheets, and to initiate the redeposition of two or more lifted sheets onto the stack ST when the suction cups 33 lift two or more sheets at a time. The signals which are furnished by the indicating device including the element 10 can also serve to supply visual indications of the number of lifted sheets, for example, by completing the circuit or circuits of one or more electric signal lamps 11, 12 to thus inform the operator that a fresh stack ST should be placed onto the table or support 35*a*, to remove two or more intercepted coherent sheets from the space in front of the stops 38, or to carry out another remedial step in the event of repeated failure of the sheet feeding apparatus to deliver discrete (single) sheets 1.

FIG. 2*a* shows the movable feeler 5 in a first position it assumes when the suction cups 33 descend to their lower end positions in order to attract and lift the uppermost sheet 1 of the stack ST. The lower arm 6' of the feeler 5 has been moved out of the way so that the suction cups 33 can rise to the second positions shown in FIG. 2*b* and place the trailing edge of the lifted topmost sheet 1 against the fixed feeler 4 at the scanning station 500. The cylinder chamber 14*b* (FIG. 2) then receives pressurized fluid (while the chamber 14*a* discharges fluid into the atmosphere) so that the feeler 5 moves through an intermediate position shown in FIG. 2*b* and to the second position shown in FIG. 2*c* whereby its arm 6' presses the lifted sheet 1 against the fixed feeler 4. The angular position of the feeler 5 is then indicative of the thickness of sheet material between the feeler 4 and arm 6' whereby the element 10 causes the indicating device of the transducer to furnish a signal which indicates whether the cups 33 carry a single sheet, two or more sheets, or no sheets at all.

The indicating device which includes the element 10 on the upper arm 6'' of the movable feeler 5 is of the type known as contact free initiator and further includes a U-shaped member 10*a* mounted on an adjustable holder 15 (FIG. 2) and having a gap 10*b* into which the element 10 extends when the feeler 5 assumes the second position shown in FIG. 2*c*. The extent to which the element 10 penetrates into the gap 10*b* indicates the thickness of sheet material (or the absence of sheet material) between the feeler 4 and the arm 6' at the scanning station 500. It is assumed that the cups 33 have lifted a single sheet 1; therefore, the indicating device of the transducer does not furnish any signals or generates a signal which does not interrupt or otherwise affect the operation of the printing units 34–34*b* and/or the normal movements of suction cups 33.

FIG. 2*d* shows the suction cups 33 in raised or second positions but without a sheet adhering thereto. The angular position of the feeler 5 is indicative of the absence of a sheet whereby the indicating device of the transducer generates a signal which completes the circuit of the lamp 12 and causes an evaluating circuit 10*c* to transmit a signal to an amplifier 10*d* which changes the condition of a time-delay relay 10*e* serving to interrupt the operation of the printing units 34, 34*a*, 34*b* with a requisite delay, i.e., with a delay which is required to transport a sheet from a position above the stack ST into the first printing unit 34. The signal from the evaluating circuit 10*c* also results in retention of stops 38 in the intercepting positions shown in FIG. 1. Instead of using the relay 10*e* as a means for interrupting the operation of printing units 34, 34*a*, 34*b* in a predetermined sequence, such interruption can be effected by suitable detector means (e.g., in the form of grippers or tongs) which are provided in the printing units and are capable of detecting the absence of sheets. Such detector means may also include one or more conventional photoelectronic detectors. The detector or detectors may serve to interrupt the feed of printing ink in the unit 34, 34*a*, and/or 34*b*.

The transducer of FIG. 2*d* further comprises two photoelectric detectors 8 and 9 each having a light source 39 and a photosensitive receiver 40. The light sources 39 are connected with an energy source U. In the absence of a sheet between the feeler 4 and the arm 6', the element 10 interrupts the light beams between the two sources 39 and the respective receivers 40 whereby the evaluating circuit 10*c* furnishes a signal to complete the circuit of the lamp 12 and to change the condition of the relay 10*e*.

Figure 2E:
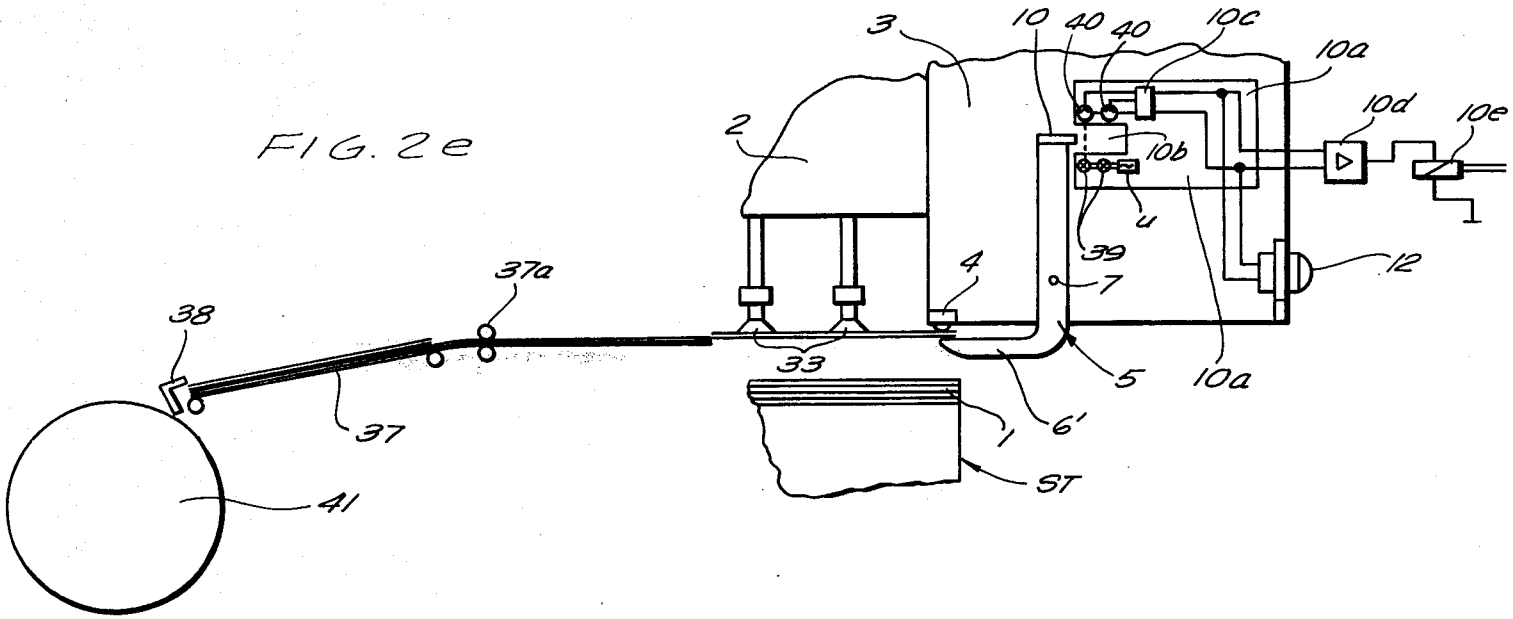
FIG. 2*e* illustrates the parts of the sheet feeding apparatus of FIG. 2 in positions they assume when the lifting members remove more than one sheet at a time.

FIG. 2*e* shows that the raised suction cups 33 carry two sheets 1. The angular position of the movable feeler 5 is such that the element 10 does not interrupt any of the light beams issuing from the sources 39 so that the evaluating circuit 10*c* completes the circuit of the lamp 11 (FIG. 2) and causes the relay 10*e* to maintain the stops 38 in the intercepting positions not later than when the two coherent sheets reach and advance with the upper stretch of the conveyor 37 shown in FIG. 1.

The transducer may comprise a single lamp (12) which lights up in response to detected absence of sheets or in response to detection of two or more coherent sheets. The last single sheet 1 which moves through the printing machine PM interrupts the operation of units 34, 34*a*, 34*b* in proper sequence and in a manner as outlined above. The lighting of lamp 12 indicates to the attendant that the stops 38 have intercepted a plurality of sheets which must be removed from the conveyor 37 by hand or must be automatically directed into a different path for evacuation from the printing unit 34.

Figure 2F:
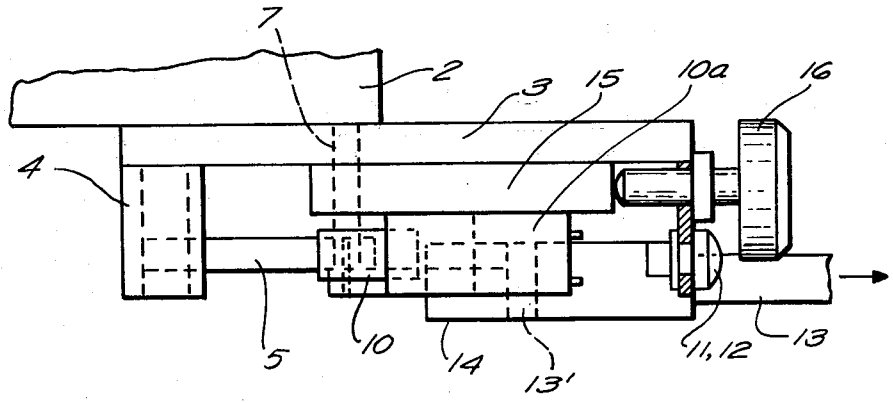
FIG. 2*f* is a plan view of the sheet feeding apparatus of FIG. 2.

FIG. 2*f* is a plan view of the structure shown in FIGS. 2–2*e*. The U-shaped member 10*a* with the detectors 8, 9 (not shown in FIG. 2*f*) is mounted on the adjustable holder 15 which is mounted on the shaft 7 and is biased by a spring 15*a* (FIG. 2) so that it bears against the stem of an adjusting screw 16. This screw meshes with the carrier 3 and can be rotated by hand to thereby change the angular position of the holder 15 and hence the positions of detectors 8, 9 relative to the plate-like light-interrupting element 10 on the upper arm 6'' of the movable feeler. The spring 15*a* is attached to a post 15*b* on the carrier 3 and to a post 15*c* on the holder 15. The screw 16 is rotated when an attendant desires to calibrate the transducer so as to make sure that the indicating device will produce signals in response to detection of single sheets, plural sheets or no sheets at all. During calibrating, the attendant rotates the screw 16 while the feelers 4, 5 grip the rear edge of a sheet 1 at the scanning station 500. The lamp 12 does not light up when the transducer is properly calibrated.

Figure 3:
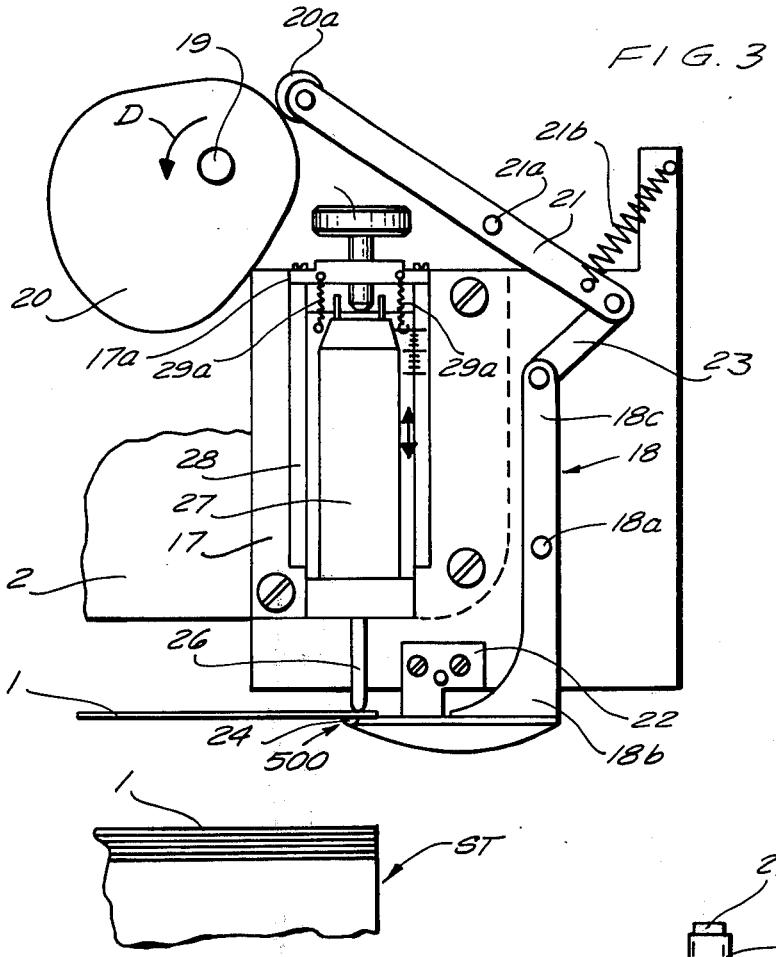
FIG. 3 is a fragmentary side elevational view of a portion of a second sheet feeding apparatus which comprises discrete means for respectively detecting the presence of plural sheets and the absence of sheets.

The motor including the cylinder 14 can be replaced by other types of prime mover means for the feeler 5, e.g., by one or more electromagnets (not shown) which are deenergized and energized in synchronism with the operation of printing units 34, 34*a*, 34*b*, or by a prime mover using cam and follower means and a link train (FIG. 3). Also, the feeler 5 can be moved by two or more hydraulic, pneumatic, electromagnetic or other motors.

Figure 2G:
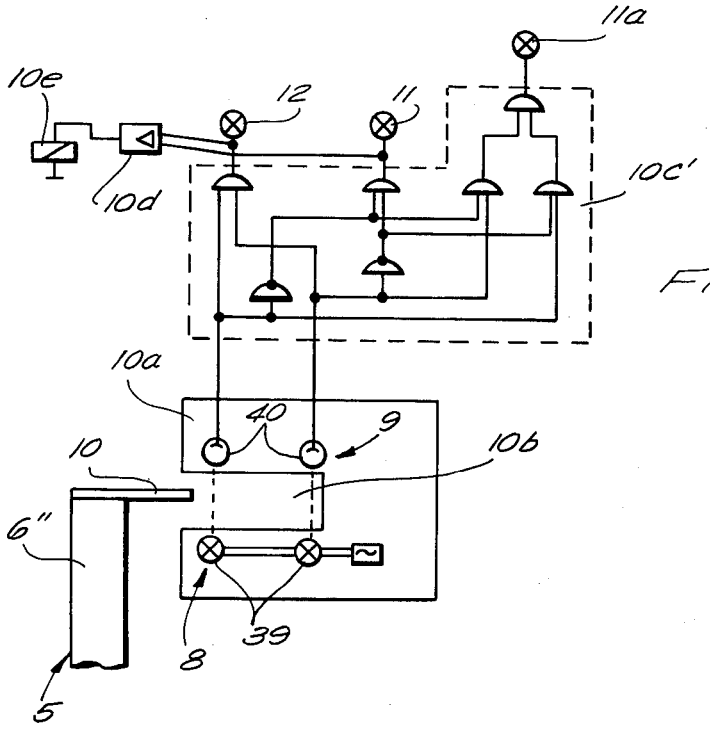
FIG. 2*g* illustrates a presently preferred embodiment of the indicating device in the transducer of the sheet feeding apparatus of FIG. 2.

FIG. 2*g* illustrates a presently preferred transducer having an evaluating circuit 10*c'* which constitutes a slight modification of the evaluating circuit 10*c* of FIGS. 2*d*–2*e*. The circuit 10*c'* controls three signal lamps 11, 11*a* and 12. The lamp 12 lights up when the plate-like light-obstructing element 10 on the upper arm 6'' of the movable feeler 5 fails to penetrate into the gap 10*b* of the U-shaped member 10*a*, i.e., when the suction cups 33 (not shown in FIG. 2*g*) have lifted two or more sheets. The circuit 10*c'* then receives signals from the receivers 40 of both photoelectric detectors 8, 9 and causes the lamp 12 to light up. At the same time, the amplifier 10*d* changes the condition of the time-delay relay 10*e* which retains the stops 38 (not shown in FIG. 2*g*) in their intercepting positions.

When the element 10 penetrates into the gap 10*b* to such an extent that it interrupts the light beam between the light source 39 and receiver 40 of the detector 8 (i.e., when the suction cups 33 have lifted a single sheet), the detector 8 furnishes to the evaluating circuit 10*c'* a signal which causes the lamp 11*a* to light up and to indicate to the attendant that the suction cups have lifted a single sheet. The condition of the relay 10*e* then remains unchanged and the printing units 34, 34*a*, 34*b* are operated in the normal way.

If the suction cups 33 fail to lift a sheet, the element 10 penetrates into the gap 10*b* to such an extent that it interrupts the light beams between the light sources 39 and the receivers 40 of both detectors (8, 9). The evaluating circuit 10*c'* then completes the circuit of the lamp 11 which lights up to indicate to the attendant that the feeding of discrete sheets is interrupted, for example, due to exhaustion of the supply of sheets on the table 35*a*. The aforementioned detector means in the units 34, 34*a*, 34*b* then detects the absence of a sheet and interrupts the operation of the units 34, 34*a*, 34*b* in a predetermined sequence. The operation of the units 34, 34*a*, 34*b* returns to normal as soon as the feeding apparatus begins to supply discrete sheets.

The transducer of FIG. 2*g* is preferably calibrated in such a way that the lamp 11 lights up when the distance between the feelers 4, 5 at the scanning station 500 (not shown in FIG. 29) is less than the minimum anticipated thickness of a sheet 1.

Figure 2H:
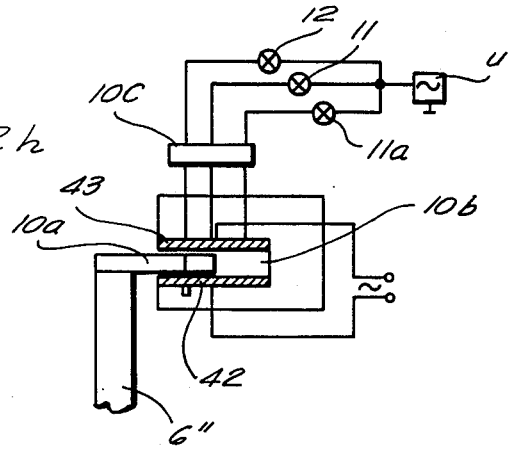
FIG. 2*h* illustrates a modified indicating device for use in the transducer of the sheet feeding apparatus of FIG. 2.

The heretofore described transducers use photoelectric detector means. However, it is equally within the purview of the invention to provide the transducer with an inductance, for example, in a manner as shown in FIG. 2*h*. The gap 10*b* of the U-shaped member 10*a* is flanked by two capacitor plates 42, 43 and the element 10A constitutes a movable plate. The capacitor including the plates 10A, 42, 43 is connected with the evaluating circuit 10C which causes the lamp 11, 11*a* or 12 to light up in dependency on the extent to which the element 10A penetrates into the gap 10*b*, i.e., on the thickness of sheet material which is located between the lower arm of the movable feeler 5 and the fixed feeler 4 (not shown in FIG. 2*h*). The evaluating circuit 10C can further control the stops 38 and/or the operation of the printing unit 34*b*, 34*a* and/or 34.

Figure 2J:
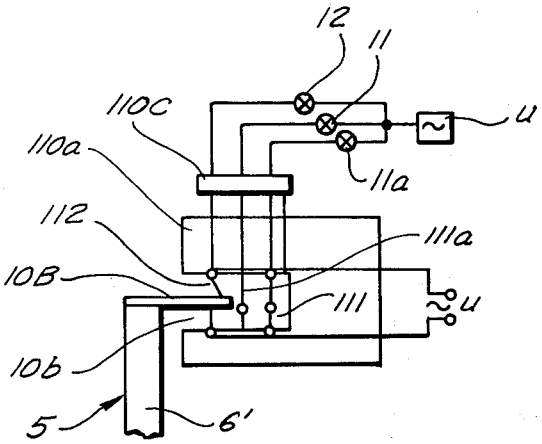
FIG. 2*j* illustrates a further indicating device for the transducer in the sheet feeding apparatus of FIG. 2.

FIG. 2*j* illustrates a portion of a monitoring device which constitutes a further modification of the monitoring device shown in FIGS. 2–2*g*. The gap 10*b* contains three limit switches 112, 111*a*, 111 which are normally closed. The element 10B constitutes a switch actuating means or trip and can open the switch 112, the switches 112, 111*a* or the switches 112, 111*a* and 111 to thereby cause the evaluating circuit 110C to complete the circuit of the lamp 12, 11*a*, or 11. The lamp 12 lights up when the lower arm of the movable feeler 5 presses two or more sheets against the fixed feeler 4 (not shown in FIG. 2j). The lamp 11*a* lights up when the suction cups 33 (not shown) have lifted a single paper sheet 1, and the lamp 11 lights up when the suction cups 33 failed to lift any sheets. The circuit 110C can also control the stops 38 and/or one or more printing units.

The structure of FIG. 2*g* may be modified by omitting the switch 112. Thus, the lamp 12 lights up when the penetration of element or trip 10B does not result in the opening of any switches, the lamp 11*a* lights up in response to opening of the switch 111*a*, and the lamp 11 lights up in response to opening of the switch(es) 11 (and 11*a*). At least the innermost switch 111 can be mounted in such a way that it is closed (rather than opened) by the element 10B when the latter's position is indicative of the absence of sheets between the feelers 4 and 5.

FIGS. 3, 3*a*, 3*b* and 4 illustrate a second monitoring device having a transducer which can be used as a substitute for the transducer of FIGS. 2–2*g*, FIG. 2*h* or FIG. 2*j* and which comprises two portions or sections, one for detection of two or more sheets 1 and another for detection of the absence of sheets.

The feeler means of the transducer of FIGS. 3, 3*a*, 3*b* and 4 is also mounted on a supporting box 2 which is connected with a plate-like carrier 17. The carrier 17 supports the horizontal shaft 18*a* for a movable feeler 18 which is a two-armed lever and the lower arm 18*b* of which corresponds in some respects to the lower arm 6' of the movable feeler 5 shown in FIG. 2. A cam 20 which is rotatable on or with a camshaft 19 is driven in a counter-clockwise direction (arrow D) and cooperates with a roller follower 20*a* at one end of a two-armed motion transmitting lever 21 fulcrumed at 21*a* and articulately connected with the upper arm 18*c* of the movable feeler 18 by a link 22. A spring 21*b* biases the roller follower 20*a* against the periphery of the cam 20. The cam 20 forms part of a motor for the feeler 18 and for the moving parts of the printing unit 34*b*, 34*a* and/or 34 (not shown in FIGS. 3, 3*a*, 3*b* and 4), and the configuration of its peripheral cam face is such that the movements of the feeler 18 are synchronized with movements of drums and other parts in the printing unit or units.

In the angular position which is shown in FIG. 3, the cam 20 maintains the lower arm 18*b* of the movable feeler 18 in engagement with a fixed (but preferably adjustable) abutment 23 on the carrier 17. The arm 18*b* assumes such position after the suction cups 33 (not shown in FIG. 3) have completed their upward movement, i.e., a movement upwardly and away from the stack ST. A contact plate 24 on the arm 18*b* then presses the sheet or sheets 1 which adhere to the suction cups against a downwardly extending axially movable feeler 26 which constitutes the input element or pin of a modified indicating device 27 some details of which are shown in FIG. 3*b*. The extent to which the feeler 26 is moved upwardly in response to completed movement of the arm 18*b* into engagement with the abutment 23 is indicative of the thickness of sheet material between the plate 24 and the feeler 26 whereby the device 27 produces a visible signal whenever the plate 24 bears against the lowermost sheet of two or more sheets 1 at the scanning station 500.

The entire indicating device 27 is adjustable relative to the carrier 17 in order to allow for proper calibration of the transducer. As shown in FIG. 3, the carrier 17 is provided with vertical guide means or ways 28 for slidably guiding the body of the indicating device 27, and the latter is biased upwardly by two helical springs 29*a* so that is normally bears against the tip of an adjusting screw 29 which meshes with a bracket 17*a* on the carrier 17. By rotating the adjusting screw 29, an attendant can select the starting or undepressed position of the feeler 26 in dependency on the thickness of a single sheet 1. The starting position of the feeler 26 will be selected with a view to insure that the device 27 produces a signal only and alone when the space between the feeler 26 and plate 24 receives at least two sheets. The width of the space between the feeler 26 (in starting position) and the plate 24 (when the arm 18*b* engages the abutment 23) is preferably selected with a view to take into consideration eventual fluctuations in the thickness of individual sheets 1.

As shown in FIG. 3*b*, the feeler 26 constitutes one contact of a switch 45 which is closed when the space between the feeler 26 and plate 24 receives two or more sheets 1. The switch 45 then completes the circuit of a signal lamp 44 (corresponding to the lamp 12) which lights up to indicate that the stops 38 (not shown in FIG. 3*b*) are about to intercept two or more sheets. The indicating device 27 including the switch 45 can further control the drive means for the camshaft 19 and the means for moving the stops 38 to intercepting positions.

The feeler 18 is arranged to displace the feeler 26 during the last stage of its movement to the (second) position which is determined by the abutment 23. The extent of displacement of the feeler 26 is a function of the thickness of sheet material between the feelers 18 and 26. The arrangement may be such that the feeler 26 is displaced only when the station 500 receives two or more sheets, or that the feeler 26 is displaced to a first extent (not sufficiently to close the switch 45) when the station 500 is free of sheets or receives a single sheet 1 and to a second extent (sufficient to close the switch 45) when the station 500 receives two or more sheets.

Figure 3A:
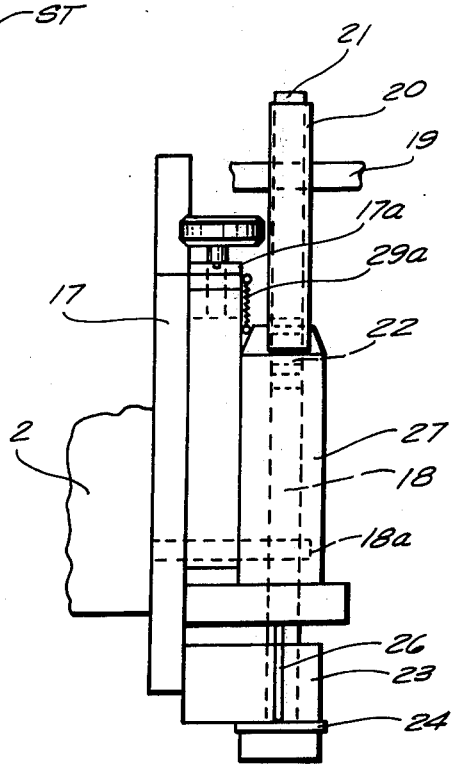
FIG. 3*a* is a plan view of the structure shown in FIG. 3.
Figure 3B:
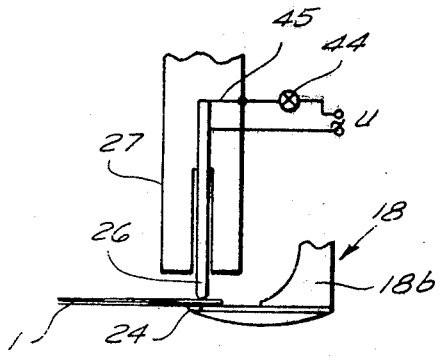
FIG. 3*b* is a vertical sectional view of an indicating device forming part of the transducer in the apparatus of FIGS. 3 and 3*a;*
Figure 4:
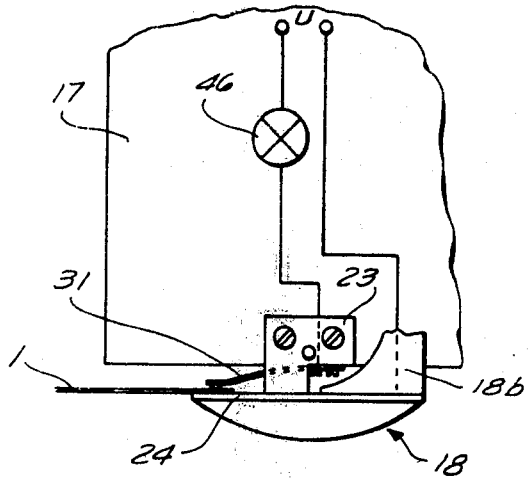
FIG. 4 is a fragmentary side elevational view of that portion of the second sheet feeding apparatus which serves to detect the absence of sheets.

The structure shown in FIG. 4 forms part of the monitoring device which includes the structure of FIGS. 3, 3*a* and 3*b*. This structure produces signals in response to detection of the absence of sheets between the plate 24 on the lower arm 18*b* of the movable feeler 18 and an elastic contact 31. The plate 24 forms part of an electric switch which is closed when the plate 24 can directly engage the contact 31. The switch 24, 31 then completes the circuit of a lamp 46 which lights up to indicate that the space between the feeler 26 and the plate 24 does not contain any sheets while the plate 24 bears against the abutment 23. The elastic contact 31 can be secured directly to the abutment 23 or to the carrier 17. When the lamp 46 indicates the absence of sheets, the aforementioned detector means of the printing machine PM automatically interrupts the operation of the printing units 34, 34*a*, 34*b* in a predetermined sequence.

Figure 5:
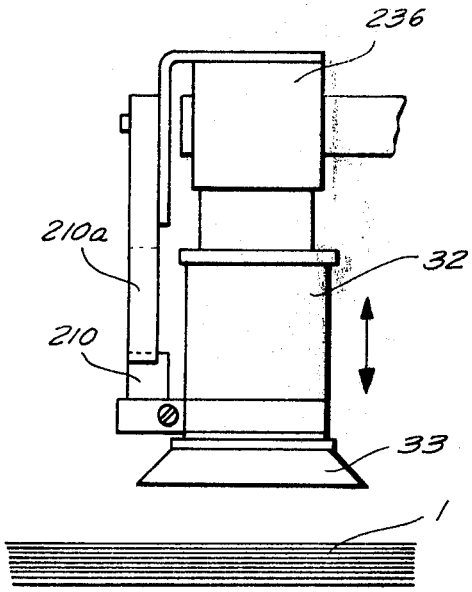
FIG. 5 is a side elevational view of a portion of a third sheet feeding apparatus wherein the lifting member or members which serve to remove sheets from a stack form part of a stack form part of a transducer for indicating the absence of sheets.

FIGS. 5 to 7 illustrate a monitoring device which includes one or more suction cups 33. This monitoring device can be used in addition to those shown in FIGS. 2–2*g*, FIG. 2*h*, FIG. 2*j* or FIGS. 3, 3*a*, 3*b*, 4 and is designed to determine and indicate the absence of sheets, i.e., the failure of the suction cup or cups 33 to lift any sheets above the stack ST. Such monitoring operation is independent of the aforedescribed monitoring operations.

A sleeve 32 which carries the cup 33 of FIGS. 5–7 at its lower end is provided with a plate-like element 210 which is analogous to the element 10 of FIGS. 2–2*g* and forms part of an indicating device. The sleeve 32 is movable with the suction cup 33 between the positions shown in FIGS. 5*a* and 5*b*. In the position of FIG. 5*b*, the sleeve 32 abuts against a shoulder 36. When the suction cup 33 descends onto the topmost sheet 1 of the stack ST, its interior is sealed from the atmosphere so that the pressure therein decreases under the action of a vacuum pump P shown in FIG. 7. This causes the cup 33 to rise and to lift the topmost sheet 1 to the position shown in FIG. 7. The element 210 enters the gap 210*b* of a U-shaped member 210*a* on the hollow upper portion 236 of the sheet lifting means. The indicating device of the transducer does not produce a signal because the operation of sheet lifting means is normal. The portion 236 then moves in the direction indicated by arrow 33A (FIG. 1) and transfers the leading edge of the single sheet 1 into the nip of the advancing rolls 37*a*. The suction in the interior of the cup 33 collapses automatically when the portion 236 completes its movement in the direction of arrow 33A, or the advancing action of the rolls 37*a* may be selected in such a way that they overcome the suction in the cup 33 and strip the single sheet 1 off the lifting means for delivery onto the conveyor 37. The portion 236 may actuate a valve 336 which connects the interior of the cup 33 with the atmosphere when the leading edge of a single sheet 1 reaches the advancing rolls 37*a* and which thereupon again connects the interior of the cup 33 with the pump P not later than when the cup reaches the position shown in FIG. 5*a* and is ready to pick up a fresh sheet 1.

In the absence of a sheet at the underside of the cup 33, the sleeve 32 remains in its lower end position and the element 210 of the indicating device does not enter the gap 210*b*. Consequently the detector including the light source 239 and receiver 240 produces a signal which completes the circuit of a lamp 212. At the same time, the signal from the receiver 240 causes an amplifier 210*d* to energize a relay 210*e* which holds the stops 38 in their intercepting positions. The detectors in the printing machine PM then terminate or interrupt the operation of printing units 34, 34*a*, 34*b* in a predetermined sequence.

The movement of the parts 32, 33 to the positions shown in FIG. 5*b* takes place automatically when the suction in the cup 33 increases, i.e., when the underside of the cup is sealed by a sheet. The raised cup 33 and/or sleeve 32 then closes a switch (not shown) which initiates the movement of the portion 236 in the direction of arrow 33A. When the portion 236 reaches its end position nearest to the advancing rolls 37*a*, it actuates a further switch which reverses the direction of its movement so that the cup 33 returns into the space above the stack ST and is ready to pick up the next sheet 1.

The suction cup or cups 33 of FIGS. 5–7 can be replaced by auxiliary cups which serve the sole purpose of detecting the absence of sheets. Thus, the structure of FIGS. 5–7 may comprise one or more first suction cups 33 for the lifting and transfer of sheets and one or more auxiliary suction cups which serve to detect the absence of sheets, i.e., the failure of the cup or cups 33 to lift one or more sheets 1 above the stack ST.

The indicating device including the photoelectric detector 239, 240 of FIG. 7 can be replaced by an indicating device with two or more photoelectric detectors or by a device employing one or more capacitors, inductances or limit switches. In each instance, the indicating device is responsive to the absence of a change of pressure in the interior of the suction cup 33 when the latter does not carry a lifted sheet and/or to the failure of the cup 33 and/or sleeve 32 to move to the position shown in FIG. 7. The indicating device of the transducer shown in FIGS. 5–7 may employ a diaphragm which is deformed in response to increasing vacuum in the cup 33; in the absence of such deformation, the device produces a signal indicating the failure of the cup 33 to lift one or more sheets 1 off the stack ST.

It is also possible to mount the member 210*a* of FIG. 7 in such a way that its gap 210*a* receives the element 210 only while the cup 33 moves in the direction indicated in FIG. 1 by the arrow 33A. Since such movement of the cup 33 takes place only when the cup attracts at least one sheet 1, the failure of the element 210 to enter the gap 210*b* is indicative of the absence of a sheet at the underside of the cup 33, and the indicating device then produces one or more signals (see the lamp 212 and relay 210*e* of FIG. 7).

The members 236, 32 respectively constitute the first and second portions of a composite holder for the suction cup 33. The portion 32 supports the element 210 and the portion 236 supports the member 210*a*. The parts 210, 210*a*, 239, 240 constitute the components of a contact-free initiator which produces a signal whenever the element 210 does not enter the gap 210*b*, i.e., when the movement of the suction cup 33 from its lower end position (engagement with the topmost sheet 1 of the stack ST) to its raised or second position (FIG.

7) did not result in the removal of one or more sheets from the stack.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is:

1. In an apparatus for feeding sheets from a stack into a printing or another sheet processing machine, a combination comprising a support for a stack of sheets; lifting means including at least one pneumatic lifting member movable between a first position of engagement with the topmost sheet of the stack on said support and a second position whereby the movement of said lifting member to said second position normally results in the removal of a single sheet from the stack on said support; and transducer means comprising a holder for said lifting member, said holder including a first portion and a second portion movable with said lifting member relative to said first portion when said lifting member carries a sheet during movement to said second position, and said transducer means further comprising a contact-free initiator having a first part provided on said first portion and a second part provided on said second portion and cooperating with said first part to produce a signal when said second portion fails to move relative to said first portion whereby such signal indicates that said lifting member does not carry a sheet in said second position thereof.

* * * * *